US006234824B1

(12) United States Patent
Chang

(10) Patent No.: US 6,234,824 B1
(45) Date of Patent: May 22, 2001

(54) STRUCTURE OF A SOCKET FOR ENSURING A SECURED RETENTION OF A PLUG CONNECTED TO THE SOCKET

(76) Inventor: Chi-Tsai Chang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/589,740

(22) Filed: Jun. 9, 2000

Related U.S. Application Data

(62) Division of application No. 09/312,767, filed on May 17, 1999.

(30) Foreign Application Priority Data

Nov. 10, 1998 (TW) ..... 87218630

(51) Int. Cl.[7] ..... H01R 4/50; H01R 13/625
(52) U.S. Cl. ..... 439/346
(58) Field of Search ..... 439/346

(56) References Cited

U.S. PATENT DOCUMENTS 5,791,931 * 8/1998 Burkhart, Sr. ..... 439/346

* cited by examiner

*Primary Examiner*—Brian Sircus
*Assistant Examiner*—Javaid Nasri
(74) *Attorney, Agent, or Firm*—A & J

(57) ABSTRACT

The present invention relates to an improved structure of a socket which ensures a secured retention of a plug connected to the socket. The socket comprises a set of swinging rods being pivotally mounted at the central section of the bottom edge of the rod. A press-hold member enclosed a spring is disposed in between the space formed by the rods and is used to appropriately press and hold the pivotally connected bottoms edge of the rods such that the swinging rods can be opened (extended) or closed (retracted) about the pivoted point. When the prongs of a plug are inserted into the socket and pressed at the press and hold member, the bottom edge of the swinging rods which curved upward into a horizontal flat position are pressed. At this instance, the protrusion on the top end of the rods will be inserted into the hole provided at the end of the prongs as a result of forward movement of the swinging rods. Thus the prongs will not be dislocated when the plug is connected to the socket.

1 Claim, 5 Drawing Sheets

STRUCTURE OF A SOCKET FOR ENSURING A SECURED RETENTION OF A PLUG CONNECTED TO THE SOCKET

CROSS REFERENCE

This is a division to the pending patent application Ser. No. 09/312,767 filed May 17, 1999.

BACKGROUND OF THE INVENTION (a) Field of the Invention

The present invention relates to an improved structure of a socket and in particular to a socket which allows the prongs of a plug to trigger the press-hold member of the socket to press downward and in turn to fasten or secure the prongs of the plug such that the prongs will not be dislocated from the socket.

b) Description of the Prior Art

The purpose of a connection between a socket and a plug is to provide an extension of current supply from a source.

In the currently available sockets, the stability of these sockets depend on the clipping force of the conductive elements within the socket. At such, when the sockets have been used for a long time or the size of the prongs of a socket is not accurate with respect to the insertion holes of the socket the retention or the clipping force of the conductive elements becomes weak or loose. In such case, when the socket or the plug of an electrical appliance is accidentally touched, the plug may dislocate or fall off from the socket and thus, an interruption of current supply is occurred. To solve this problem, most of the people may widen or narrow the distance in between the two prongs of the plug so as to fix the prongs to the socket By the adjustment of the distance of the prongs to be inserted into the socket, the clipping of the prongs maybe improved. However, in actual practice, such adjustment does not improve the stability or the mounting capability of the socket This is because the prongs are normally rigidly fixed to the plug structure and are not flexible. The prongs are not easily extended and if they are extended with great force, the rigidly fixed ends of the prongs within the plug may be damaged. This way of adjusting the clipping ability of the plug to fit the socket is not feasible. Another way to solve this problem is to change the insertion holes of a socket. But, in actual practice, this method is not possible as the clipping force of a socket is greatly depending on the elasticity of the conductive elements of the socket. With regard to the current supply to computers, where the current supply cannot be interrupted, unexpected current interruption often causes a great loss to the users. As a result of this, it is the aim of the inventor to design a socket with improved structure, which provides secured retention of the prongs of a plug at the socket.

SUMMARY OF THE INVENTION

The present invention relates to an improved structure of a socket which ensures a secured retention of a plug connected to the socket. The socket comprises a set of swinging rods being pivotally mounted at the central section of the bottom edge of the rod.

The object of the present invention is therefore to provide an improved retention structure of a socket capable of firmly secure the prongs of a plug when the prongs are inserted into the socket.

It is another object of the present invention to provide an improved retention structure of a socket which substantially eliminates or reduces disadvantages and problems associates with related prior art-sockets.

Additional objects and advantages of the invention will be set forth in the description which follows. The object and advantages of the invention may be realized and obtained pointed out in the appended claims.

DETAILED DESCRIPTION OF THE PREFERRED EMBODIMENT

Figure 1:
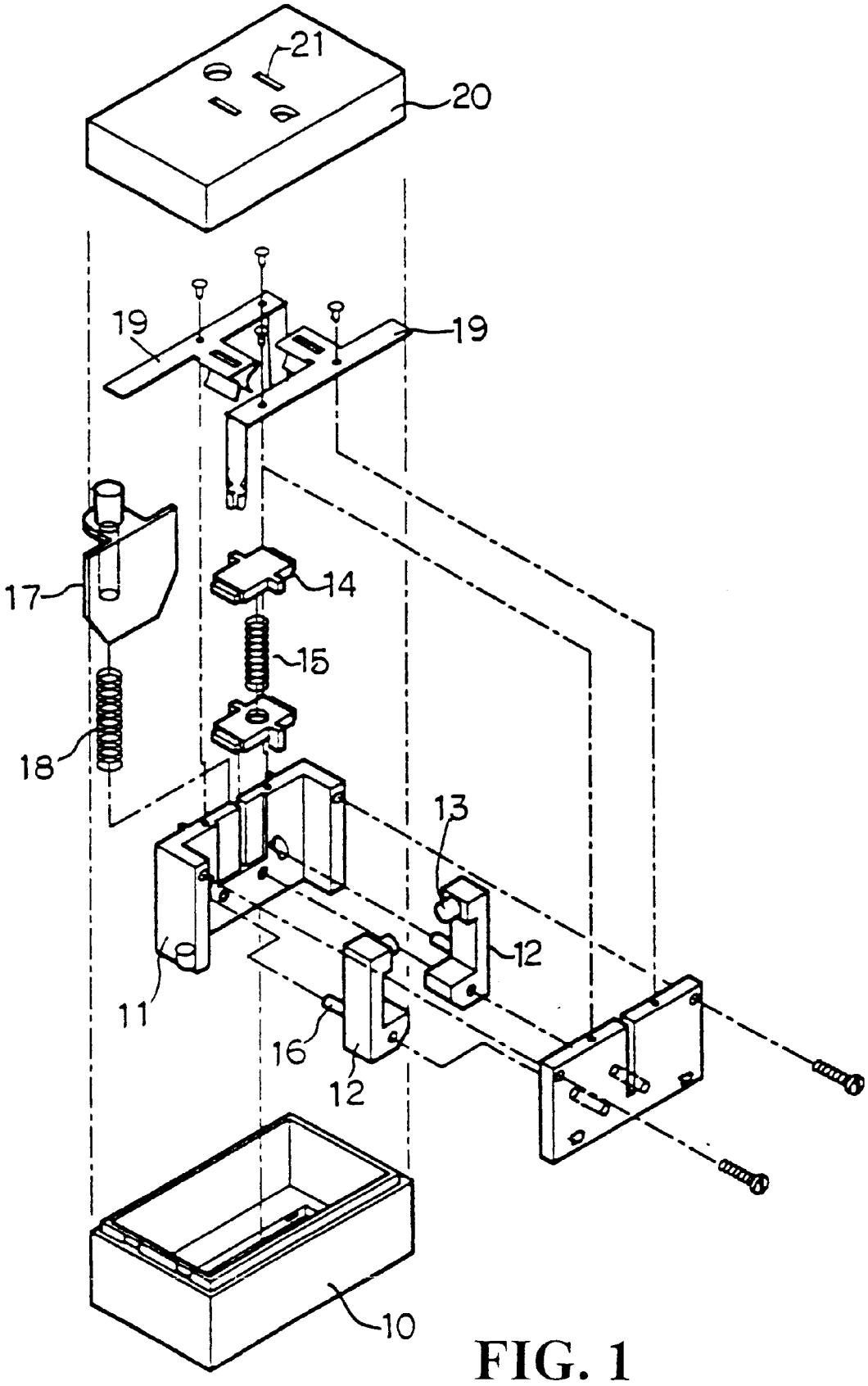
FIG. 1 is a perspective exploded view of a socket in accordance with the present invention.
Figure 2:
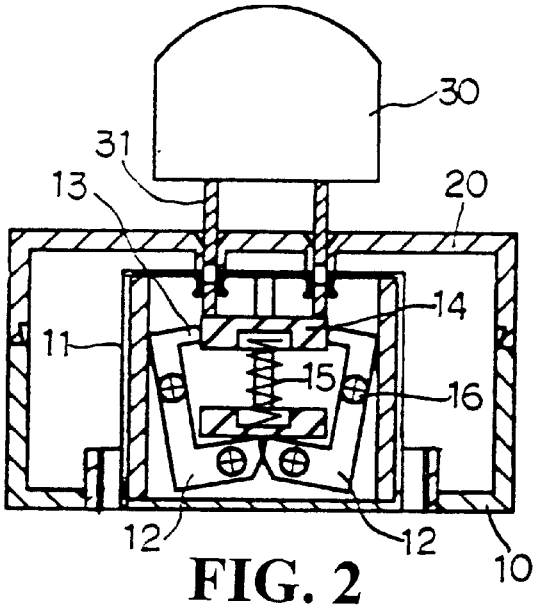
FIG. 2 is a schematic view of the socket (with a plug) in accordance with the present invention.

FIG. 1 is an exploded perspective view of the socket in accordance with the present invention. Referring also the FIGS. 2 to 4, there is shown the improved structure of the socket comprises a socket body 10, a covering plate 20, a fixing frame 11, a set of swinging rods 12 and a pair of conductive elements 19. In accordance with the present invention, the socket body 10 is hollow and is box-like structure for the mounting of the fixing frame 11. One swinging rod 12 is mounted at one internal lateral edge of the frame 11 or a pair of swinging rods 12 are mounted at both the internal lateral edges of the frame 11.

Figure 5:
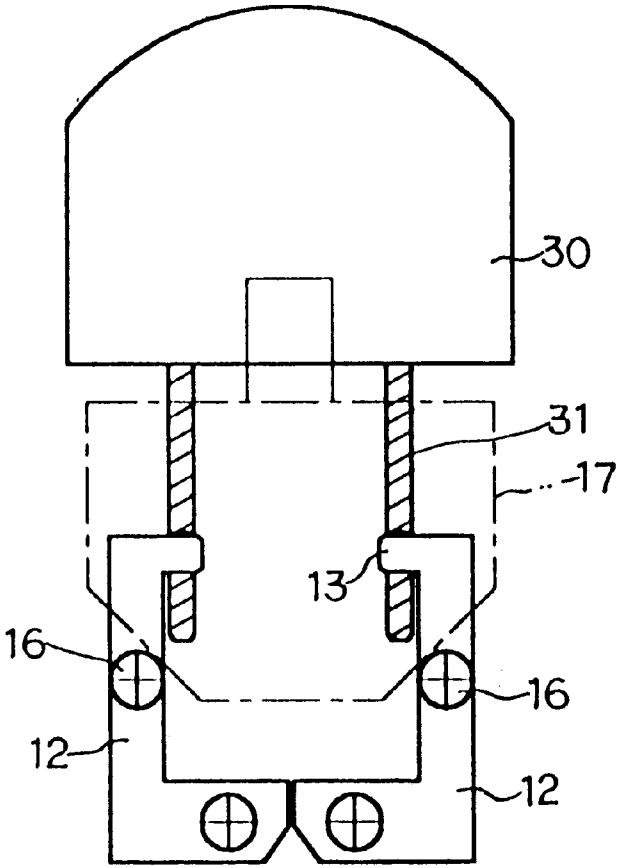
FIG. 5 is a schematic view showing the withdrawal of the plug from the socket in accordance with the present invention.
Figure 7:
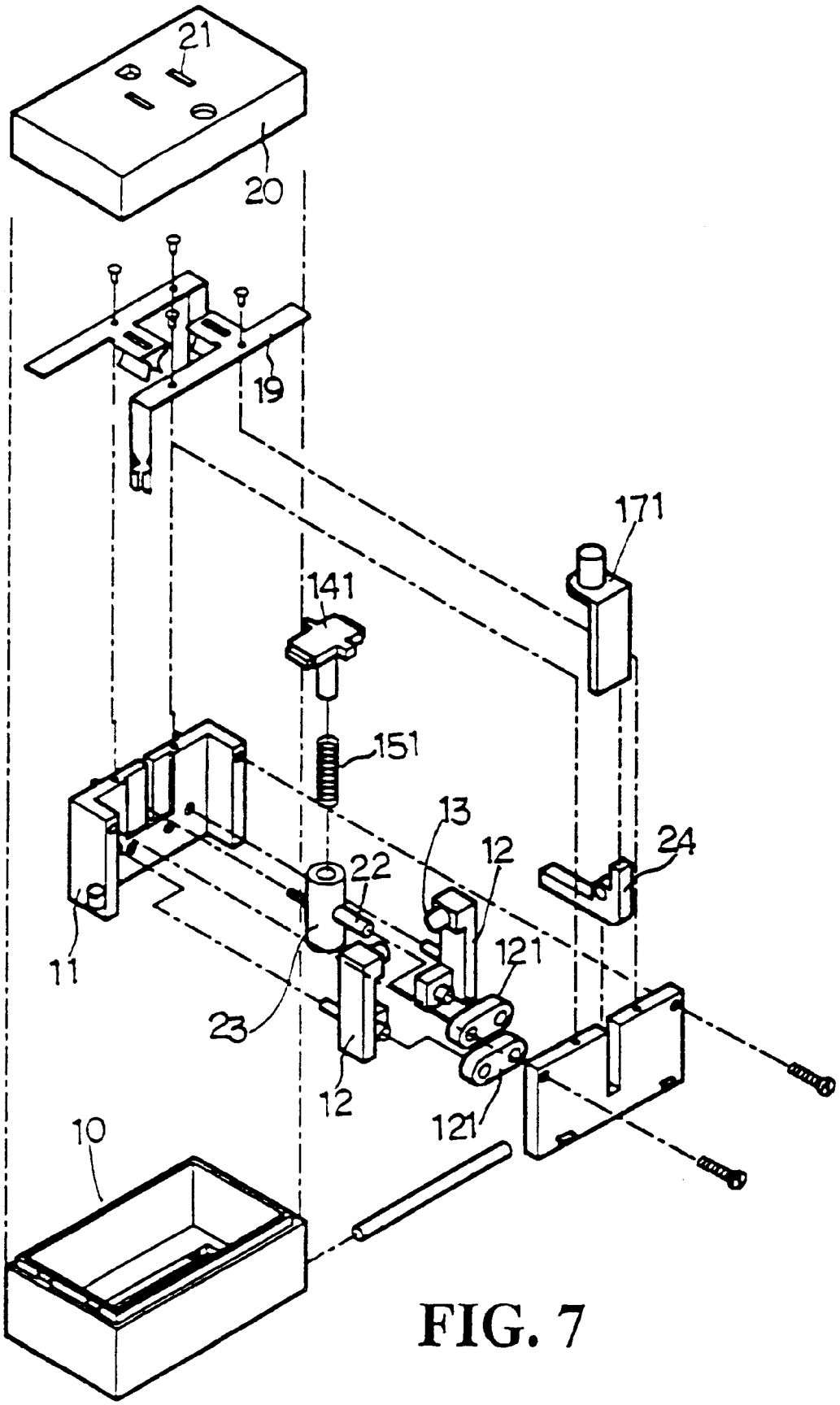
FIG. 7 is an exploded perspective view of the socket of another preferred embodiment.
Figure 9:
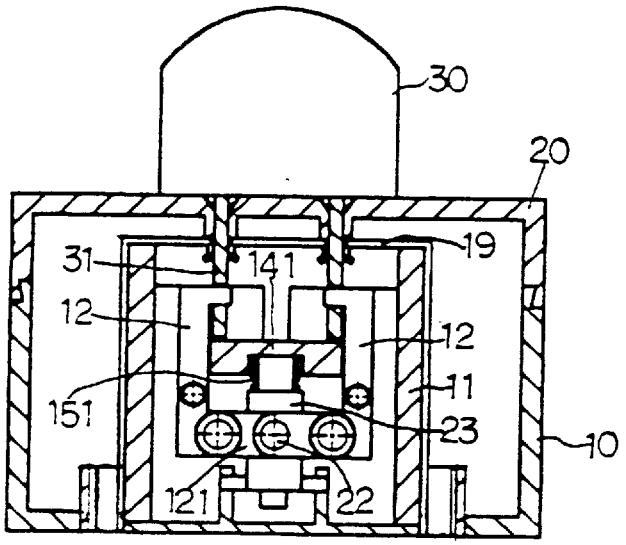
FIG. 9 is an elevation view showing the combination of the plug with the socket in accordance with FIG. 7 of the present invention.
Figure 8:
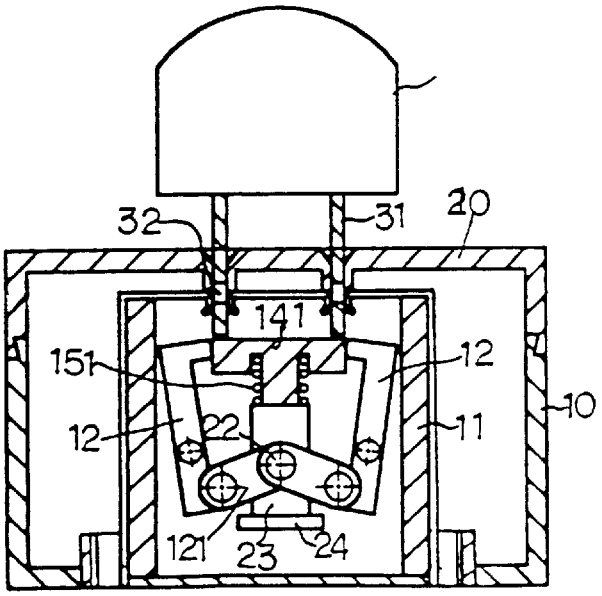
FIG. 8 is an elevation view showing the plug within the socket of FIG. 7.
Figure 10:
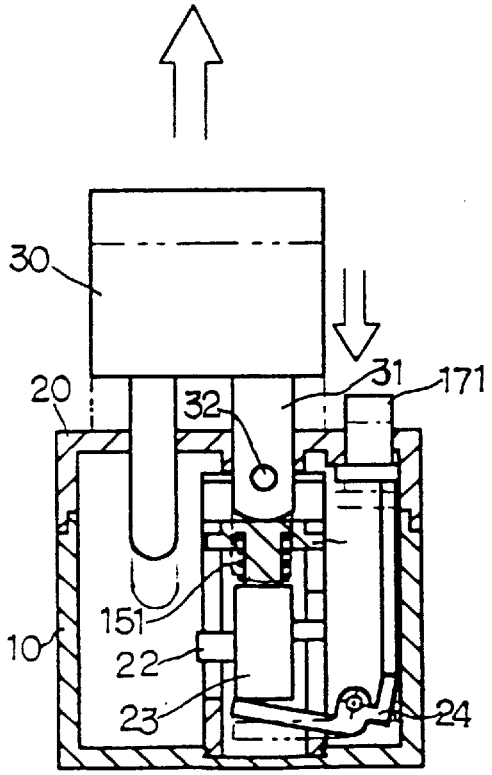
FIG. 10 shows the movement of the plug with rest of the socket of FIG. 7 in accordance with the present invention.

In accordance with the present invention and referring to FIG. 1, the swinging rods 12 are symmetrical and are mounted at both the lateral edges of the fixing fame 11. A protrusion 13 is formed at the top end of the swinging rod 12. The central section of the bottom edge of the rods 12 is pivotally mounted to the socket body 10 such that the rods 12 move about the hinged point and form a V shaped when the rods are in an extended position. A press-hold member 14 enclosed a spring 15 is mounted within the space formed by the set of swinging rods 12. The bottom face of the press-hold member 14 can touch the bottom edge of the swinging rod 12. The top face of the press-hold member 14 touches the protrusion 13 of the swinging rods 12 and the press-hold member 14 is used to adjust the opening position of the swinging rods 12 which facilitates the urging of the prongs 31 of a plug. A cylindrical bar 16 is protruded at one lateral side of the rod 12 (which is shown in FIG. 5) and at the corresponding position of the bar 16, an actuating disc 17 is provided. The disc 17 has a top end slightly protruded above the covering plate 20. The lower section of the disc 17 is mounted with a spring 18. A pair of conductive elements 19 are mounted on the top of the fixing frame 11. The positive terminal, negative terminal and the earth wire (not shown) of the power supply are connected to the conductive elements 19.

Referring to FIGS. 2 to 6, the use of the socket in accordance with the present invention is explained as follows: the prongs 31 of a plug 30 are inserted into the socket via the corresponding insertion holes 21 provided on the covering plate 20 of the socket. When the prongs 31 are inserted into the socket, the press-hold member 14 within the socket body 10 is depressed by the prongs 31 such that the slightly curved central section of the bottom edge of the rods 12 is pressed into a horizontal flat position (as shown in FIG. 5). Due to the depression of the swinging pivoted rod 12 at the bottom edge, the top section of the rods 12 moves forward to the prongs 31 and the protrusions 13 at the top end of the rod 12 also move forward and are inserted into the holes 32 provided at the end of the prongs 31 and a secured retention of the prongs 31 is obtained. Thus, the secured prongs 31 will not be dislocated from the socket.

Figure 3:
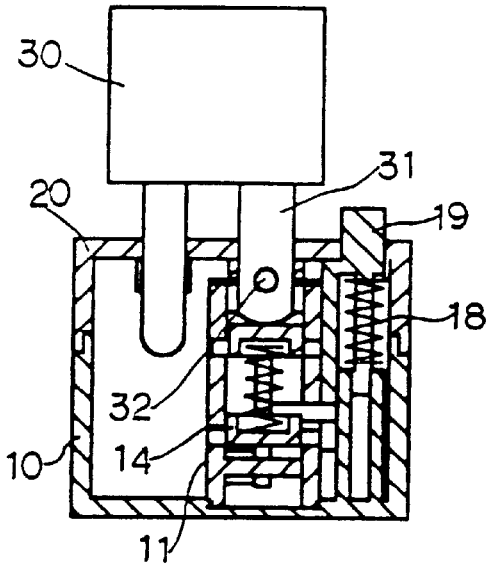
FIG. 3 is an elevational view of the combination of a plug with the socket in accordance with the preset invention.
Figure 4:
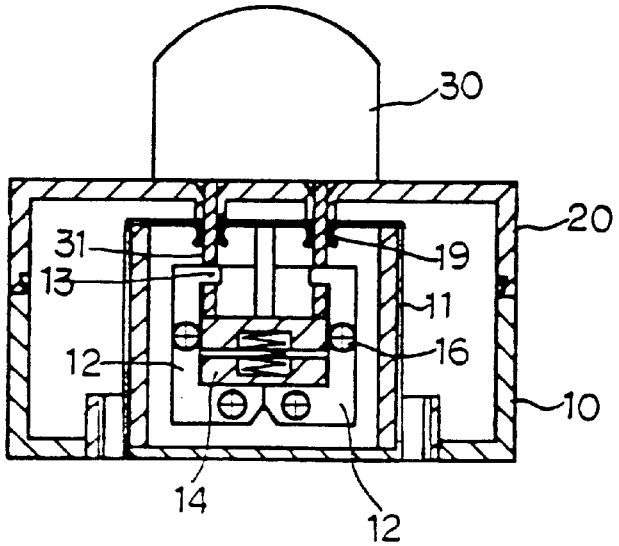
FIG. 4 is a schematic view showing the plug within the socket in accordance with the present invention.
Figure 6:
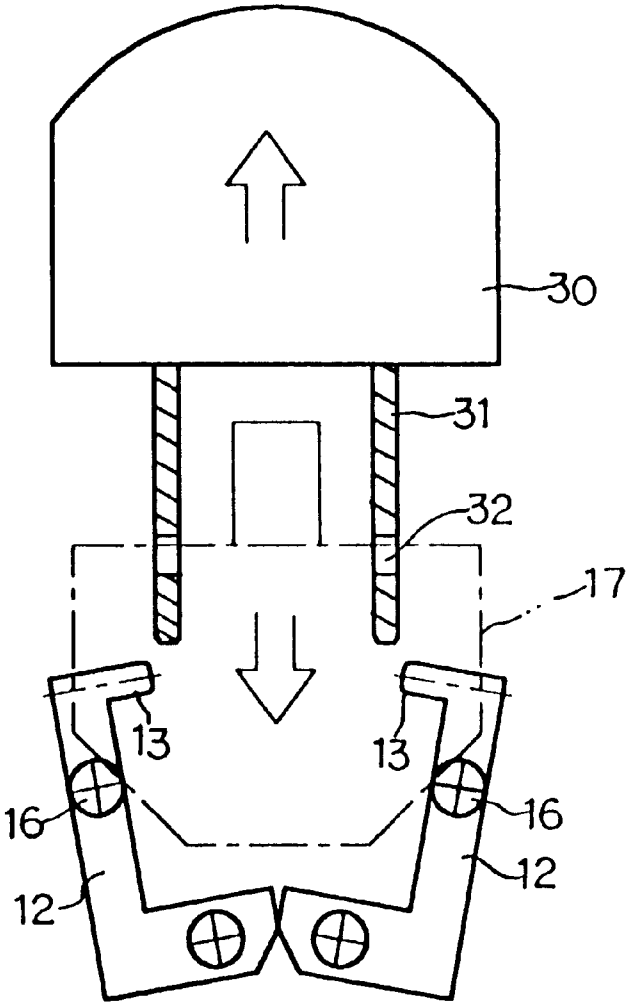
FIG. 6 is another schematic view showing the withdrawal of the plug from the socket in accordance with the present invention.

When desired to disconnect the plug 30 from the socket, the top end of the actuating disc 7 (the disc 17 has a top end slightly protruded above the covering plate 20) is depressed. As shown in FIGS. 3 and 6, when the actuating disc 17 is depressed, the cylindrical bars 16 are widened as a result of the depression of the disc 17 and thus, the swinging rods 12 are extended and opened. As such, the protrusions 13 disengage from the holes 32 of the prongs 31. Accordingly, the prongs 30 can be easily disconnected from the socket. At this moment, the press-hold member 14 will restore to its position and the swinging rods 12 will also restore to its original position before the insertion of the plug.

Reference to FIG. 7 to 10 illustrates another preferred embodiment, the top end of the swinging rods 12 are provided with the protrusions 13 and the bottom end is connected with a crankshaft 121 which in turn connected to a pivotal shaft 22. The shaft 22 is mounted to a central sliding block 23. The sliding movement of the sliding block 23 will cause simultaneously movement of the swinging rods 12. The top end of the sliding block 23 is mounted with a press-hold member 141 enclosing a spring 151. The press-hold member 141 presses the block 23 so that the block 23 moves in an up and down direction. The bottom end of the sliding block 23 is mounted to one end of a lever 24. The other end of the lever 24 is connected to an actuating disc and slightly protruded above the covering plate 20 of the socket.

When the prongs 31 are inserted into the socket via the insertion holes 21 on the covering plate 20, the press-hold member 141 is slightly pressed and the sliding block 23 is simultaneously moved downward. The crankshaft 121 is thus moved such that the rods 12 move inward and the prongs 31 are thus positioned. The protrusions 13 of the top end of the swinging rods 12 are inserted into the holes 32 at the ends of the prongs 31 and thus secured retention of the prongs 31 with the socket is obtained.

If the plug 30 is to be disconnected from the socket, the protruded actuating disc 171 is depressed which in turn moves the bottom end of the lever 24 which causes the other end to move the sliding block 23. At this moment, the crankshaft 121 is moved and the swinging rods 12 are opened. At this instance the prongs 31 are disconnected from the protrusions 13 of the swinging rods 12.

I claim:

1. An improved structure of a socket comprising a socket body, a fixing frame, a set of swinging rods, a covering plate and a press-hold member, wherein said fixing frame is mounted within said socket body, said swinging rods are mounted within said fixing fame, a protrusion is provided at a top end of a respective one of said swinging rods, an end of each of two crankshafts is connected with a bottom end of each of said swinging rods, a pivotal shaft is connected to other ends of said crankshafts, said pivotal shaft is mounted on a central sliding block, said press-hold member is provided with a spring and fitted on said central sliding block such that when said press-hold member is pressed downward by insertion of prongs of a plug, said protrusion of said swinging rods will be inserted into a hole provided at an end of a respective one of said prongs, a pair of conductive elements are mounted on said fixing frame and arranged corresponding to insertion holes provided on a top surface of a covering plate, a bottom end of said central sliding block is mounted to an end of a lever, another end of said lever is connected to an actuating disc having a top end slightly protruded above said covering plate.

* * * * *